US006437317B1

(12) United States Patent
Focke et al.

(10) Patent No.: US 6,437,317 B1
(45) Date of Patent: Aug. 20, 2002

(54) METHOD AND APPARATUS FOR INSPECTING CIGARETTE HEADS

(75) Inventors: Heinz Focke, Verden; Ralf Sinnerbrink, Kirchlinteln; Winfried Niebler, Flintsbach, all of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/567,017

(22) Filed: May 9, 2000

(30) Foreign Application Priority Data

May 12, 1999 (DE) ..... 199 21 725

(51) Int. Cl.[7] ..... G01V 9/04

(52) U.S. Cl. ..... 250/222.1; 250/221; 250/222.2; 250/223.12

(58) Field of Search ..... 250/221, 222.1, 250/216, 222.2, 223 R, 224, 208.2, 559.22, 559.45; 131/905–908, 910; 209/536; 356/237, 445, 488

(56) References Cited

U.S. PATENT DOCUMENTS 5,569,931 A * 10/1996 Ghini et al. ..... 250/559.45
5,596,187 A * 1/1997 Di Stefano et al. ..... 250/222.2

FOREIGN PATENT DOCUMENTS

| | | |
|---|---|---|
| DE | 36 18 190 | 12/1986 |
| DE | 38 19 653 | 12/1988 |
| DE | 40 00 658 | 8/1990 |
| DE | 36 38 519 | 7/1994 |
| DE | 44 24 045 | 1/1996 |
| EP | 157 087 | 1/1985 |
| EP | 585 686 | 8/1993 |
| EP | 630 586 | 6/1994 |
| EP | 634 112 | 7/1994 |

OTHER PUBLICATIONS

Bechtel, Klaus: Beruhrungslos positionieren mit Laser. In: Der Konstrukteur, S 3/89, S. 78, 80, 82.

* cited by examiner

*Primary Examiner*—Robert H. Kim
*Assistant Examiner*—Hoon Koo Sonp
(74) *Attorney, Agent, or Firm*—Sughrue Mion, PLLC

(57) ABSTRACT

The invention relates to a method for inspecting cigarette heads (25, 41, 61), where light radiates in at least two strip-like portions (26–31), which are incident from different directions, onto the end area (39, 42) of a cigarette head (25, 41, 61) and light (33) reflected from the end area (39, 42) is received by a detector (32) and evaluated. Known methods of this type have the disadvantage that they are inaccurate and do not allow exact statements to be made about the state of cigarettes. Therefore, the invention is based on the problem of improving the inspection of cigarettes. This problem is solved by virtue of the fact that, in the course of evaluation, a distance (B, C) between two lines (54, 55, 68, 69) which are produced from a signal generated by the detector (32) and correspond to the strip-shaped portions (26–31) is determined in order to establish the position of that region of the cigarette head (25, 41, 61) which is irradiated by the portions (26–31). Furthermore, the invention relates to a corresponding apparatus.

13 Claims, 2 Drawing Sheets

Fig. 1
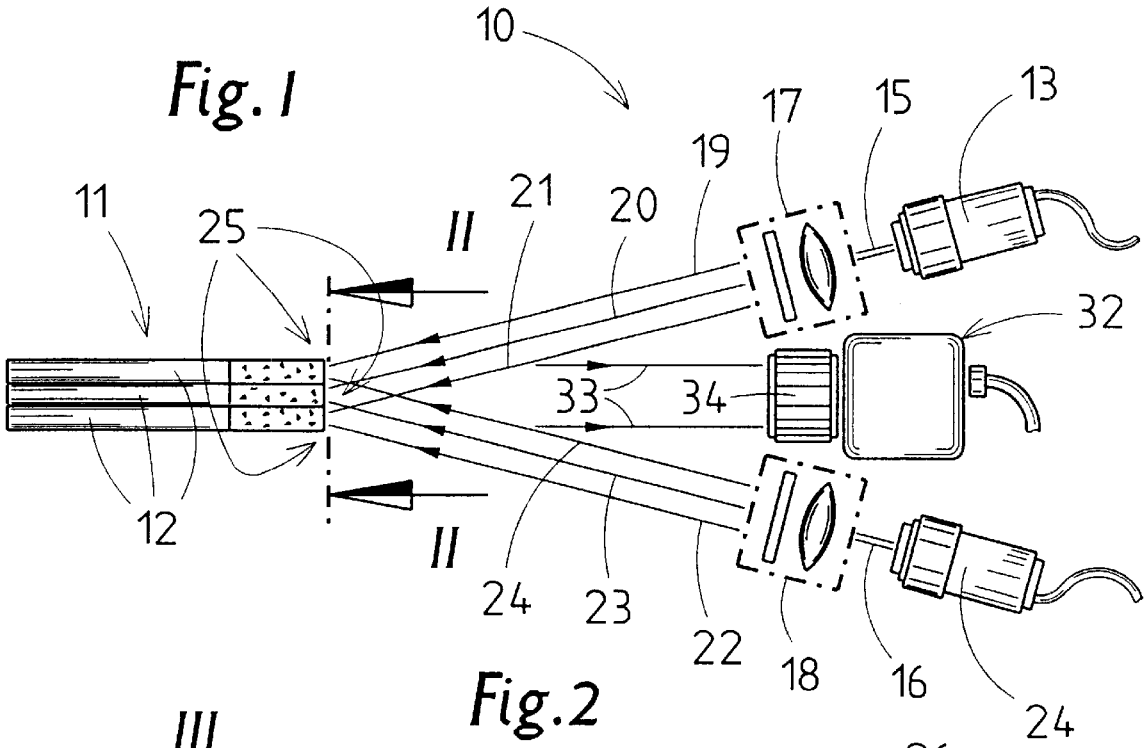
Fig.2
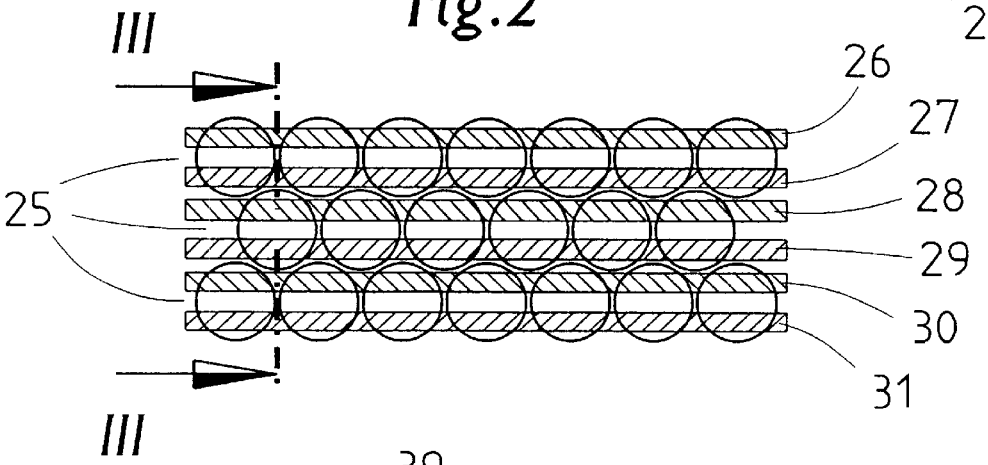
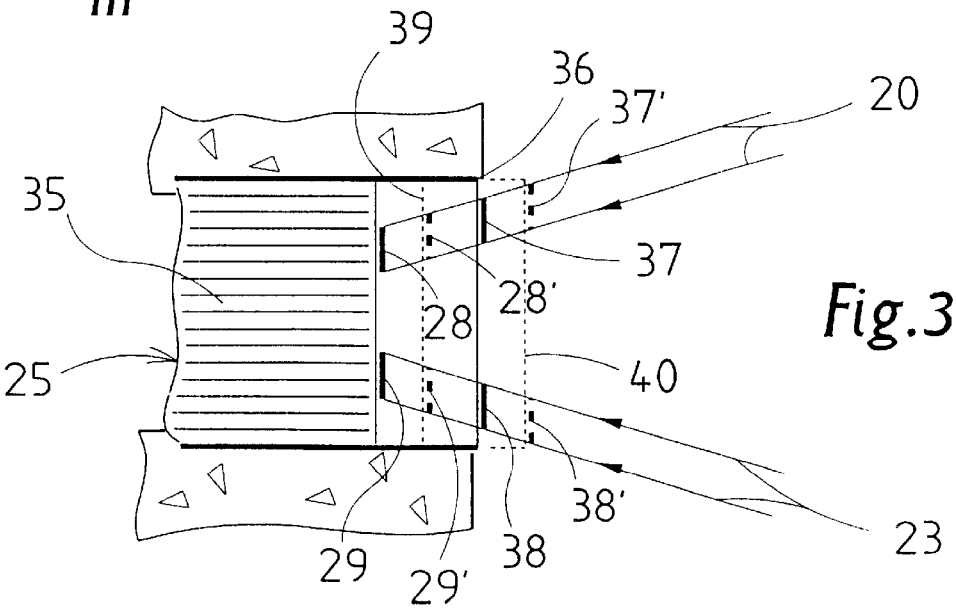
Fig.3

41
47
42

50
48
45
51
43
42
53
52
44
49
46

56
57
54
55
B
59
58
41
A 50
48
43
51
44
53
52
49

56
57
54
C
55
59
58

41
60

48
51
43
44

56
57
54
55
59
58

61
63
62

50
66
51
64
65
52
53
67

56
57
68
69
59
58

61
63
62

50
66
64
51
65
52
53
67

56
57
68
69
59
58

METHOD AND APPARATUS FOR INSPECTING CIGARETTE HEADS

BACKGROUND OF THE INVENTION

1. Field of the Invention

The invention relates to a method for inspecting cigarette heads, where light radiates in at least two strip-like portions, which are incident from different directions, onto the end area of a cigarette head and light reflected from the end area is received by a detector and evaluated. Furthermore, the invention relates to an apparatus for inspecting cigarette heads having at least two light sources for illuminating a respective strip-like portion of an end area of a cigarette head from different directions, and having a detector for receiving light reflected from the end area.

2. Description of Prior Art

Inspection methods and inspection apparatuses for the contactless inspection of cigarette heads are known, in which one or more straight lines is or are radiated onto the cigarette head on the tobacco side. If the cigarette is not properly filled with tobacco, the line—when it is observed from a different viewing angle—no longer appears as a straight line but rather as a wavy line or as an interrupted wavy line. This image is acquired by a sensor. Finally, the pixels lying inside and outside a narrow region around an imaginary, theoretical straight line are counted and put into a ratio with respect to one another. If this ratio exceeds a limit value, this is suppose to indicate that a cigarette is not properly filled.

This type of inspection has the disadvantage that it is inaccurate and does not allow exact statements to be made about the state of a cigarette.

Therefore, the invention is based on the problem of improving the inspection of cigarettes and providing more accurate statements about the state of a cigarette.

SUMMARY OF THE INVENTION

In order to solve this problem, the method according to the invention is defined by the fact that, in the course of evaluation, a distance between two lines which are produced from a signal generated by the detector and correspond to the strip-shaped portions is determined in order to establish the position of that region of the cigarette head which is irradiated by the portions. Furthermore, the problem is solved by means of an apparatus according to the invention, which has an evaluation device for evaluating a signal generated by the detector, which evaluation device is designed to determine a distance between two lines which are produced from the signal and correspond to the strip-shaped portions, in order to establish the position of that region of the cigarette head which is irradiated by the portions.

The invention makes use of the insight that two light bands which run toward one another and impinge as strips of light on an object to be measured, namely a cigarette head, provide information about the distance between the object to be measured and the measuring arrangement or another fixed point, or generally about the position of the object to be measured. In this case, the distance between the two strips of light which impinge on the object to be measured provides the desired information about the position of the object to be measured.

This type of contactless inspection of cigarette heads is suitable in particular for recessed filter cigarettes or Papyrossi cigarettes, in which case, with these cigarettes, the strips of light also at least partially impinge on the end of the cigarette casing or the tip sleeve and the light reflected from these regions as well is received by the detector and evaluated. As a result, a point-like light spot is obtained when the strip of light impinges upon or intercepts the casing or tip sleeve. These point-like light spots provide an orientation point for the end of the cigarette or of the tip. The strips of light which impinge on the tobacco or filter are set back relative to the end edge of the tip in the case of these cigarettes (with a hollow tip). The depth of the tip sleeve can therefore be established from a distance between the images of these point-like light spots or strips of light on the detector.

The result of the inspection can be used to generate a error signal if a cigarette does not comply with predetermined limit values. Such an error signal leads to the ejection of a cigarette in the cigarette production or packaging process. Preferably, a formation comprising a plurality of layers of cigarettes is simultaneously inspected and, if appropriate, the entire formation is ejected if a defective cigarette occurs.

BRIEF DESCRIPTION OF THE DRAWING

Further preferred embodiments of the invention emerge from the subclaims and from the exemplary embodiments illustrated in the drawing. In the drawing:

FIG. 1 shows an inspection apparatus according to the invention for inspecting heads of a cigarette formation with a light source arranged directly upstream of a lens-diaphragm system;

FIG. 2 shows a section along the Line II—II in accordance with FIG. 1, which shows the end areas of cigarette heads of a cigarette formation which are illuminated by strips of light;

FIG. 3 shows a section along the Line III—III in accordance with FIG. 2, which shows the geometrical structure of the incident light beams in order to elucidate the distance conditions of the strips of light;

DETAILED DESCRIPTION OF THE INVENTION

Figures 4A, 4B, 4C, 5A, 5B, 5C, 6A, 6B, 6C, 7A, 7B, 7C, 8A, 8B, 8C:
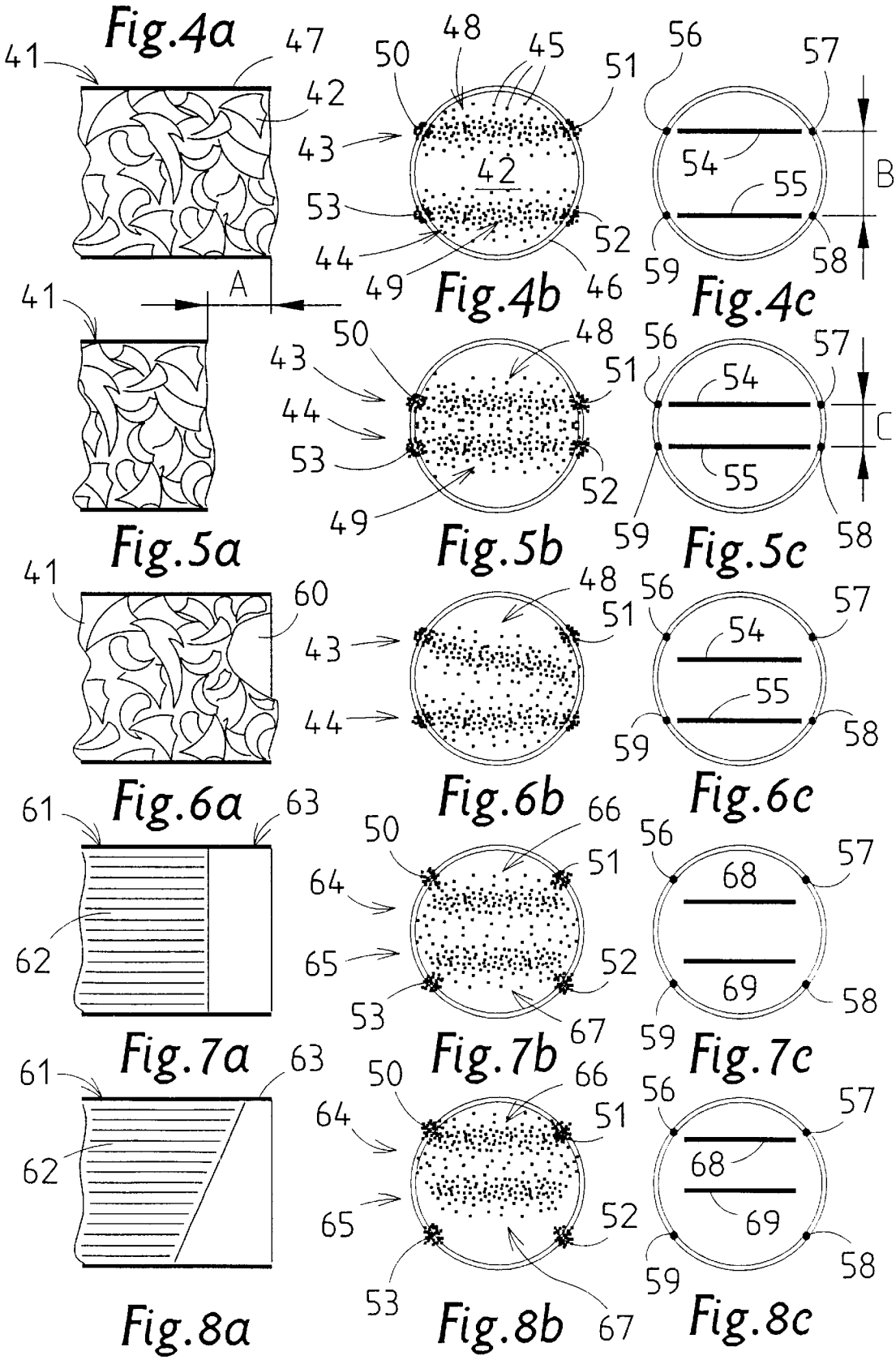
FIG. 4*a* shows the tobacco-side end of a correctly formed cigarette in longitudinal section.
FIG. 4*b* shows the end area of the cigarette head from FIG. 4*a* illuminated by two strips of light, as it is imaged on a detector.
FIG. 4*c* shows the centroid lines of the images in accordance with FIG. 4*b* on the detector, said centroid lines having been calculated by an evaluation device.
FIG. 5*a* shows the tobacco-side end of an excessively short cigarette in longitudinal section.
FIG. 5*b* shows the end area of the cigarette head from FIG. 5*a* illuminated by two strips of light, as it is imaged on a detector.
FIG. 5*c* shows the centroid lines of the images in accordance with FIG. 5*b* on the detector, said centroid lines having been calculated by an evaluation device.
FIG. 6*a* shows the tobacco-side end of a cigarette in longitudinal section with a vacancy in the tobacco in the form of a hole.
FIG. 6*b* shows the end area of the cigarette head from FIG. 6*a* illuminated by two strips of light, as it is imaged on a detector.
FIG. 6*c* shows the centroid lines of the images in accordance with FIG. 6*b* on the detector, said centroid lines having been calculated by an evaluation device.
FIG. 7*a* shows the cigarette head of a correctly formed recessed filter cigarette in longitudinal section.
FIG. 7*b* shows the end area of the cigarette head from FIG. 7*a* illuminated by two strips of light, as it is imaged on a detector.
FIG. 7*c* shows the centroid lines of the images in accordance with FIG. 7*b* on the detector, said centroid lines having been calculated by an evaluation device.
FIG. 8*a* shows a cigarette head of a recessed filter cigarette in longitudinal section with an obliquely clipped filter.
FIG. 8*b* shows the end area of the cigarette head from FIG. 8*a* illuminated by two strips of light, as it is imaged on a detector.
FIG. 8*c* shows the centroid lines of the images in accordance with FIG. 8*b* on the detector, said centroid lines having been calculated by an evaluation device.

FIG. 1 shows an inspection apparatus 10 for inspecting a cigarette formation 11 comprising cigarettes 12 arranged in three layers. The inspection apparatus 10 has two light sources 13 and 14, which each preferably comprise a laser but may also comprise another bright light source, for example an arrangement of bright light-emitting diodes. The emitted light is therefore monochromatic and coherent or monochromatic and non-coherent or non-monochromatic and non-coherent. The light sources 13, 14 are either turned on permanently, or, alternatively, may be operated in a pulsed fashion, so that they generate short flashes of light.

The light beams 15, 16 issuing from the light sources 13, 14 each pass to an optical arrangement or to a lens-diaphragm system 17, 18 or to a hologram, which convert the light beams 15, 16 in each case in three light bands 19, 20, 21 and 22, 23, 24. These light bands 19 to 24 fall onto cigarette heads 25 of the cigarettes 12, where the light bands 19 to 24 have the configuration of strip-like portions 26 to 31, as illustrated in FIG. 2. FIG. 2 shows the end areas of the cigarette heads 25 from FIG. 1. The cigarette formation 11 comprises three layers, the outer two layers comprising seven cigarettes and the middle layer comprising six cigarettes. For each layer, two strip-like portions 26 and 27, and 28 and 29, and 30 and 31 impinge on the end areas. The respective upper strip-like portions 26, 28, 30 originate from the light source 13 illustrated at the top of FIG. 1. The lower strip-like portions 27, 29, 31 correspondingly originate from the lower light source 14.

Each strip-like portion 26 to 31 covers a wide region of the end area of the respective cigarette heads 25, to be precise in each case somewhat less than half of the end area of a cigarette head. Therefore, essentially total coverage of the cigarette end area is obtained by two strip-like portions. This has the advantage that it is thereby possible to evaluate virtually the entire end area.

FIG. 1 shows a detector 32, which receives light 33 reflected from the end areas. The detector 32 has an optical arrangement 34, which serves for focusing the reflected light 33 onto a sensor. This sensor contained in the detector 32 as a CCD chip having a multiplicity of two-dimensionally arranged CCD elements. As a result, it is possible to generate the images of the strip-shaped portions 26 to 31 on the end areas of the cigarette heads on the CCD chip. The individual CCD elements each output a signal which flows to an evaluation device.

The inspection apparatus 10 that is described is preferably situated on the cigarette turret of a cigarette packaging machine. However, it may also be arranged in a similar form on the cigarette magazine and there perform presorting or ejection of individual cigarettes by means of an ejector arranged on the magazine, as is described in the published German Patent Application DE 36 20 735 A1. In the case of an inspection apparatus arranged on the cigarette turret, the identification of a defective cigarette leads to the entire cigarette formation 11 being ejected. For this purpose, the inspection apparatus generates an error signal which causes the ejector to perform ejection.

FIG. 3 shows a section along the Line III—III from FIG. 2, that is to say a longitudinal section through a cigarette head 25. This cigarette head 25 has a filter piece 35 set back relative to the end of the tip sleeve 36. The incident light bands 20, 23 irradiate the strip-shaped portions 28, 30 at the end of the filter piece 35. In addition, the light bands 20, 23 also irradiate the end of the tip sleeve 36 at end portions 37, 38. These portions 28, 29, 37, 38 illustrate the illuminated portions in the case of a recessed filter cigarette. A similar picture would be produced for a Papyrossi cigarette, the filter piece 35 in that case being replaced by tobacco, however.

The broken lines illustrated in FIG. 3 show the conditions for an excessively long cigarette 12. In the case of such a defective cigarette, the end area 39 of the filter piece 35 would end offset to the right, as would the end edge of the tip sleeve 40.

In the case of a properly formed cigarette, the portions 28 and 29 are at a specific distance from one another, as are the portions 37, 38 or the distances between the portions 28 and 37 or 38 and also 29 and 38 or 37. Defects of the cigarette heads can be inferred from these distances. Specifically, as shown in FIG. 3, these portions 28, 29, 37, 38 are displaced away from the formation if a cigarette is too long. Thus, the portion 28 is displaced to the broken line 28' shown, and 29 is displaced to the broken line 29' shown, and the end portions 37 and 38 are also displaced to broken lines 37' and 38', respectively.

FIG. 4*a* shows a longitudinal section through a cigarette head 41 of a tobaccoless cigarette with an end area 42. FIG. 4*b* shows the image produced on the detector 32 when the end area 42 is illuminated by two light bands which impinge as strip-like portions on the end area 42.

Two images 43, 44 of strip-like portions, which illuminate a multiplicity of pixels 45 illustrated as dots, impinge on the end area 42. The doubly traced circular line 6 is an imaginary representation of the cigarette paper 47 surrounding the cigarette head 41. The images 43, 44 have a central portion 48 and 49, respectively, which corresponds to the tobacco-side end area regions illuminated by the respective strip-like portions. These central portions 48, 49 are bounded by in each case two point-like end portions 50 to 53. These point-like end portions 50 to 53 correspond to bright light spots at the locations at which the strips of light impinge on the filter paper.

FIG. 4*c* shows the image generated or calculated by an evaluation device. This image need not necessarily be displayed. It is sufficient for the data on which this image is based to be calculated in order to implement the invention. A respective centroid line 54, 55 is determined from the central portions 48, 49. The centroid lines 54, 55 are advantageously calculated in such a way that they lie parallel to one another. In addition, the end portions 50 to 53 are each combined to form a centroid 56 to 59.

FIG. 5*a* shows a cigarette which is too short by comparison with the cigarette illustrated in FIG. 4*a*. The cigarette illustrated in FIG. 5*a* is shorter by the distance A than the cigarette illustrated in FIG. 4*a*. As a result of this, the central portions 48, 49 illustrated in FIG. 5*b* are closer together than those illustrated in FIG. 4*b*. The same applies to the end portions 50 to 53. This is a consequence of the light bands which run toward one another with increasing distance and lead to the portions being moved closer together.

The same applies correspondingly to the centroid lines 54, 55 and centroids 56 to 59 illustrated in FIG. 5*c*. This displacement results in a shorter distance C in FIG. 5*c* than a corresponding larger portion B in FIG. 4*c*.

FIG. 6*a* again shows the cigarette head 41 of a filterless cigarette, in which, however, some of the tobacco filling is missing. This leads to a hole 60. Therefore, in the image 43 of an upper strip of light on the detector, which image encompasses an upper portion of the end of the cigarette head 41, an irregularity is discernible in the upper central portion 48 in FIG. 6*b*. This is because the central section 48 of the image 43 is not oriented essentially horizontally but rather slopes away to the side. FIG. 6*c* shows the centroid lines 54, 55 calculated from this. The centroid line 54 illustrated in FIG. 6*c* is displaced toward the center of the cigarette by comparison with the centroid line 54 illustrated in FIG. 4*c*. This is a consequence of the hole 60. Since the lower image 44 in FIG. 6*b* corresponds to that illustrated in FIG. 4*b*, the centroid line 55 in FIG. 6*c* is at the same position as in FIG. 4*c*. The distance between the centroid lines 54, 55 now no longer corresponds to the desired distance B in accordance with FIG. 4*c*, but rather is smaller than said desired distance. A defective cigarette can be inferred from this. A further special feature of the illustrations in accordance with FIGS. 6*b* and 6*c* emerges from the fact that the intrinsically slanted portion 48 is converted into a straight centroid line 54. This orientation—compelled computationally—of the centroid lines serves for determining the distance between the centroid lines 54 and 55 more simply.

FIG. 7*a* shows the cigarette head 61 of a recessed filter cigarette with a filter piece 62 and a hollow tip 63. The strips of light which impinge as strip-like portions on the cigarette head 61 are represented as images 64, 65 on the detector 32 in accordance with FIG. 7*b*. In the case of such a correctly formed cigarette, central portions 66, 67 are situated in a manner displaced toward the cigarette axis. The end portions 50 to 53, by contrast, are located at the same position as in FIG. 5*b* for a completely filled cigarette.

FIG. 7*c* shows calculated centroid lines 68, 69, which, in the case of a proper recessed filter cigarette, are at a distance which is less than the distance C illustrated in FIG. 4*c*. In addition, the centroids 56 to 59 in FIG. 7*c* are situated at a horizontal position that differs from that of the centroid lines 68, 69. This is due to the fact that the light bands or strip-shaped portions which impinge on the cigarette head 61 are displaced toward the cigarette axis, since these portions are set back in the axial direction, that is to say are at a greater distance from the inspection apparatus.

FIG. 8*a* once again shows a cigarette head 61 of a recessed filter cigarette, in which case, however, the filter 62 is formed defectively since it has been obliquely clipped. As a result, the central portions 66, 67 of the images 64, 65 are situated at a different position in FIG. 8*b* compared with FIG. 7*b*. However, the end portions 50 to 53 of the images 64, 65 are situated at the same position as in FIG. 7*b*. FIG. 8c shows the centroid lines 68, 69 produced from the images in accordance with FIG. 8b, and also the centroids 56 to 59. The centroids 56 to 59 are not displaced relative to FIG. 7*c*, whereas the centroid lines 68 and 69 in FIG. 8*b* are displaced upward compared with FIG. 7*c*. In addition, they are at a smaller distance from one another.

The differentiation between centroid lines 54, 55 to 68, 69 and centroids 56 to 59 makes it possible to ascertain one or four reference points on the edge of the cigarette casing or tip sleeve. As a result, it is possible to make statements about set-back filters or holes in the tobacco even in a quantitative manner, that is to say that statements can be made about distances between the end edge of a cigarette and possible holes or the depth of a tip sleeve in the case of recessed filter cigarettes or Papyrossi cigarettes. By way of example, it is possible to verify by measurement whether a tip sleeve having a setpoint depth of 5 mm lies within tolerance limits of ±1 mm.

The inspection method described and also the inspection apparatus described allow a very high measurement accuracy. Furthermore, a snapshot of a cigarette head or of the cigarette heads of a cigarette formation suffices for inspecting the length of a cigarette, the depth of a tip sleeve, the form of a cigarette head and also the filling with tobacco or filter. As a result, a cigarette head can be measured in one motion. As a result—unlike in other known inspection methods in which, by way of example, a plunger is pressed onto a cigarette head—this contactless method enables a cigarette packaging or production machine to be operated at high speed. The invention therefore opens up a host of possibilities for the inspection of cigarette heads.

What is claimed is:

1. A method for inspecting cigarette heads (25, 41, 61), where light radiates in at least two strip-like portions (26–31), which are incident from different directions, onto the end area (39, 42) of a cigarette head (25, 41, 61) and light (33) reflected from the end area (39, 42) is received by a detector (32) and evaluated, wherein, in the course of evaluation, a distance (B, C) between two lines (54, 55, 68, 69) which are produced from a signal generated by the detector (32) and correspond to the strip-shaped portions (26–31) is determined in order to establish the position of that region of the cigarette head (25, 41, 61) which is irradiated by the portions (26–31).

2. The method as claimed in claim 1, wherein images of the strip-shaped portions (26–31), said images being received by the detector (32), are subjected to image processing, an area centroid line (54, 55, 68, 69) being determined, in particular calculated, as a corresponding line for each image of a strip-shaped portion (26–31).

3. The method as claimed in claim 2, wherein the area centroid lines (54, 55, 68, 69) are calculated in such a way that they run parallel to one another.

4. The method as claimed in claim 1, wherein an error signal is generated if the distance determined exceeds or falls below a limit value, in particular in order to activate an ejector for ejecting an inspected cigarette (12) or a cigarette formation (11) containing said cigarette (12).

5. The method as claimed in claim 1, wherein the strip-shaped portions (26–31) illuminate essentially the entire end area (39, 42), in particular the end area on the tobacco or filter side, of the cigarette (12).

6. The method as claimed in claim 1, wherein a strip-shaped portion (26–31) covers a plurality of cigarettes, in particular six or seven, arranged next to one another in a layer of a cigarette formation (11) and a number of strip-shaped portions (26–31) corresponding to the number of layers of the cigarette formation (11), in particular three, are radiated from each direction onto the end areas (39, 42).

7. The method as claimed in claim 1, wherein the detector (32) receives light (33) reflected in the axial direction with respect to the cigarette axis and the incident light (19–24) is radiated onto the end area (39, 42) from two directions arranged at identical angles with respect to the cigarette axis.

8. The method as claimed in claim 1, wherein both cigarette heads (25, 41, 61) of a cigarette (12) are inspected and the cigarette length is calculated from the positions obtained.

9. The method as claimed in claim 1, wherein the strip-shaped portions (26–31) partially illuminate the end of the cigarette casing, in particular of the cigarette paper surrounding the cigarette (12), and/or of the tip sleeve (63) of a recessed filter cigarette or Papyrossi cigarette, and the light (33) reflected from this end is received and evaluated.

10. The method as claimed in claim 9, wherein a distance between a centroid (56–59) of an image (50–53) of the illuminated regions (37, 38) of the cigarette casing and a centroid line (54, 55) is calculated in order to infer the depth of a tip sleeve (63) or the depth of a tobacco vacancy (60) and/or a distance between two centroids (56–59) of two images (50–53) of two illuminated regions (37, 38) of the cigarette casing is calculated in order to inspect an embodiment of the cigarette casing, in particular the uniformity thereof.

11. An apparatus for inspecting cigarette heads (25, 41, 61), in particular for carrying out a method as claimed in one of claims 1 to 10, having at least two light sources (13, 14) for illuminating a respective strip-like portion (26–31) of an end area of a cigarette head (25, 41, 61) from different directions, and having a detector (32) for receiving light (33) reflected from the end area, which has an evaluation device for evaluating a signal generated by the detector (32), which evaluation device is designed to determine a distance between two lines (54, 55, 68, 69) which are produced from the signal and correspond to the strip-shaped portions (26–31), in order to establish the position of that region of the cigarette head (25, 41, 61) which is irradiated by the portions (26–31).

12. The apparatus as claimed in claim 11, which has, assigned to a light source (13, 14), in each case a lens-diaphragm system (17, 18) and/or optical system with a hologram for generating the strip-like portions (26–31) in particular a number, in particular three, of strip-like portions (26–31) corresponding to the number of layers of a formation (11), a respective strip-like portion (26–31) being directed at a respective layer.

13. The apparatus as claimed in claim 11, which has pulsed light sources (13, 14), in particular laser or LED light sources, for generating flashes of light.

* * * * *